US010319318B2

(12) United States Patent
Kim et al.

(10) Patent No.: US 10,319,318 B2
(45) Date of Patent: Jun. 11, 2019

(54) IMAGE DISPLAY DEVICE AND DRIVING METHOD THEREOF

(71) Applicant: LG Display Co., Ltd., Seoul (KR)

(72) Inventors: Changkun Kim, Daegu (KR); Hongsung Song, Gyeonggi-do (KR); Taeyoung Jung, Daegu (KR)

(73) Assignee: LG Display Co., Ltd., Seoul (KR)

( * ) Notice: Subject to any disclaimer, the term of this patent is extended or adjusted under 35 U.S.C. 154(b) by 71 days.

(21) Appl. No.: 14/578,744

(22) Filed: Dec. 22, 2014

(65) Prior Publication Data

US 2015/0243232 A1 Aug. 27, 2015

(30) Foreign Application Priority Data

Feb. 27, 2014 (KR) ..... 10-2014-0023479

(51) Int. Cl.
*G09G 3/36* (2006.01)

(52) U.S. Cl.
CPC ..... *G09G 3/3648* (2013.01); *G09G 2310/08* (2013.01); *G09G 2320/0247* (2013.01); *G09G 2320/0261* (2013.01); *G09G 2320/103* (2013.01); *G09G 2320/106* (2013.01); *G09G 2340/0435* (2013.01)

(58) Field of Classification Search
CPC ..... G09G 2320/02; G09G 2320/0247; G09G 2320/0252; G09G 2320/0261; G09G 2320/10; G09G 2320/103; G09G 2320/106; G09G 2310/08; G09G 2340/0435; G09G 3/3648
USPC ..... 345/214
See application file for complete search history.

(56) References Cited

U.S. PATENT DOCUMENTS 6,836,293 B2 * 12/2004 Itoh ..... G09G 3/20 348/443
7,123,246 B2 * 10/2006 Nakatani ..... G06F 3/1415 345/204
8,384,826 B2 * 2/2013 Mori ..... G09G 3/3611 348/441

(Continued)

FOREIGN PATENT DOCUMENTS

CN 101197998 A 6/2008
CN 101272460 A 9/2008

(Continued)

OTHER PUBLICATIONS

Chinese Office Action dated Jan. 25, 2017 for corresponding Chinese Patent Application No. 201410817632.7.

*Primary Examiner* — Jason M Mandeville
(74) *Attorney, Agent, or Firm* — Morgan, Lewis & Bockius LLP

(57) ABSTRACT

A driving method of an image display device includes detecting an amount of data change of an input image and calculating a moving speed of the input image, determining whether the image moving speed is within a preset reference range, when the image moving speed is within the reference range, driving a display screen according to an input frame frequency synchronized to the input image, and when the image moving speed is out of the reference range, down-modulating a frame frequency for displaying the input image to a frequency lower than the input frame frequency and driving the display screen according to a modulated frame frequency.

11 Claims, 7 Drawing Sheets

(56) References Cited

U.S. PATENT DOCUMENTS

| | | | | |
|---|---|---|---|---|
| 8,395,700 | B2 * | 3/2013 | Ueno | G09G 3/20 348/441 |
| 9,019,189 | B2 * | 4/2015 | Choi | G09G 3/20 345/99 |
| 2002/0015104 | A1 * | 2/2002 | Itoh | G09G 3/20 348/459 |
| 2003/0020699 | A1 * | 1/2003 | Nakatani | G06F 3/1415 345/204 |
| 2006/0092164 | A1 * | 5/2006 | Takeuchi | G09G 3/3611 345/530 |
| 2007/0132683 | A1 | 6/2007 | Kong | |
| 2007/0273787 | A1 * | 11/2007 | Ogino | H04N 7/015 348/441 |
| 2008/0129862 | A1 | 6/2008 | Hamada et al. | |
| 2008/0165106 | A1 * | 7/2008 | Park | G09G 3/2022 345/89 |
| 2008/0225062 | A1 * | 9/2008 | Chang | G09G 3/3208 345/691 |
| 2008/0231745 | A1 | 9/2008 | Ogino et al. | |
| 2009/0251445 | A1 * | 10/2009 | Ito | G09G 3/3648 345/204 |
| 2010/0007789 | A1 * | 1/2010 | Mori | G09G 3/3611 348/459 |
| 2010/0085386 | A1 * | 4/2010 | Lin | G09G 3/3611 345/690 |
| 2011/0032419 | A1 * | 2/2011 | Sakaniwa | H04N 7/0132 348/452 |

FOREIGN PATENT DOCUMENTS

| | | | |
|---|---|---|---|
| CN | 100465709 | C | 3/2009 |
| CN | 101998029 | A | 3/2011 |

* cited by examiner

FIG. 6

Image Moving Speed: Slow → Fast

| Test Image | | IMG 1 | | IMG 2 | | IMG 3 | | IMG 4 | |
|---|---|---|---|---|---|---|---|---|---|
| Panel Model | | TM120 | TM240 | TM120 | TM240 | TM120 | TM240 | TM120 | TM240 |
| AVg | male(n=6) | 2.7 | 2.6 | 3.2 | 2.8 | 4.0 | 2.8 | 2.8 | 3.7 |
| | female(n=6) | 2.8 | 2.6 | 3.6 | 3.2 | 4.0 | 2.8 | 3.6 | 3.4 |
| Total AVg | | 2.75 | 2.6 | 3.4 | 3.0 | 4.0 | 2.8 | 3.7 | 3.55 |

TM120:120Hz
TM240:240Hz

Motion Blur Perception Level: 1 (Poor) ← → 5 (Good)

FIG. 7

| | | Panel Model | | Reduction rate |
|---|---|---|---|---|
| | | TM240 | TM120 | |
| moving image | SAMPLE IMG | 4.7W/h | 3.2W/h | 32% |

IMAGE DISPLAY DEVICE AND DRIVING METHOD THEREOF

This application claims the benefit of Korean Patent Application No. 10-2014-0023479 filed on Feb. 27, 2014, which is incorporated herein by reference for all purposes as if fully asset forth herein.

BACKGROUND OF THE INVENTION

Field of the Invention

The present disclosure relates to an image display device and driving method thereof.

Discussion of the Related Art

With rising interests in information displays and increasing demands to use portable information media, researches and commercialization of light-weight and thin-profile image displays have been actively carried out. Examples of the image displays include a liquid crystal display (LCD), an organic light emitting diode (OLED), a field emission display (FED), etc.

Among these image displays, the liquid crystal display displays moving pictures using a thin film transistor as a switching element. Liquid crystal display can be made smaller in size than cathode ray tubes and is used extensively in a personal computer, a laptop computer, and a portable device such as office automation equipment or a mobile phone. Such liquid crystal display has motion blur which makes moving pictures look not sharp but fuzzy due to the maintenance characteristics of liquid crystal.

Motion blur is caused by an image integration effect which temporarily lasts as the human eye follows moving objects. To reduce motion blur, moving picture response time (MPRT) needs to be shortened. As one of the methods for shortening the MPRT, a driving frequency variation technology is known. The driving frequency variation technology varies frame frequency, i.e., the number of frames per second, according to changes in images. In the driving frequency variation technology, changes in motion on images IMG1 to IMG4 are detected as shown in FIG. 1, and when the changes in motion on the images are less than a preset value, the images are displayed at a first frame frequency, and when the changes in motion on the images are equal to or greater than the preset value, the images are displayed at a second frame frequency which is higher the first frame frequency.

Increasing frame frequency for an image with a substantial motion change offers better motion blur reduction. However, even if frame frequency is increased for an image with quite a large motion change, it makes little difference in the level of motion blur perceived by the viewer. Increasing frame frequency also increases power consumption. In the related art driving frequency variation technology, frame frequency is unconditionally increased even for a high-speed moving image on which the viewer sees no difference in motion blur. Accordingly, the related art driving frequency variation technology is not disadvantageous in terms of power consumption.

SUMMARY OF THE INVENTION

Accordingly, the present invention is directed to a an image display device and driving method thereof that substantially obviates one or more of the problems due to limitations and disadvantages of the related art.

An object of the present invention is to provide an image display device which improves motion blur perception level and reduces power consumption and a driving method on the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving method of an image display device comprises detecting an amount of data change of an input image and calculating a moving speed of the input image, determining whether the image moving speed is within a preset reference range, when the image moving speed is within the reference range, driving a display screen according to an input frame frequency synchronized to the input image, and when the image moving speed is out of the reference range, down-modulating a frame frequency for displaying the input image to a frequency lower than the input frame frequency and driving the display screen according to a modulated frame frequency.

In another aspect, an image display device comprises a display screen for displaying an input image, a moving speed calculator that detects an amount of data change of an input image and calculates a moving speed of the input image, a moving speed determiner that determines whether the image moving speed is within a preset reference range, and a frame frequency modulator that, when the image moving speed is within the reference range, drives the display screen according to an input frame frequency synchronized to the input image, and when the image moving speed is out of the reference range, down-modulates a frame frequency to a frequency lower than the input frame frequency and drives the display screen according to a modulated frame frequency.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 6 shows a result of a motion blur perception test performed on multiple test images with different moving speeds;

FIG. 7 shows a comparison of power consumption between when a specific test image is driven at 120 Hz frame frequency and when it is driven at 240 Hz frame frequency;

DETAILED DESCRIPTION OF THE ILLUSTRATED EMBODIMENTS

Hereinafter, exemplary embodiments of the present invention will be described with reference to FIGS. 2 to 9.

Figure 1:
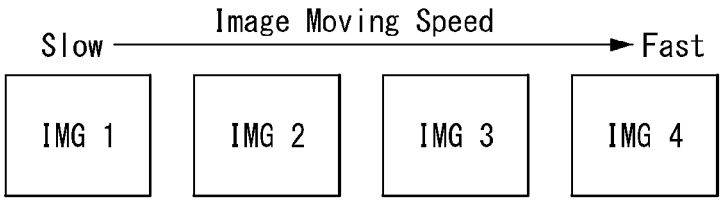
FIG. 1 (RELATED ART)
FIG. 1 is a view showing multiple test images with different moving speeds.
Figure 2A:
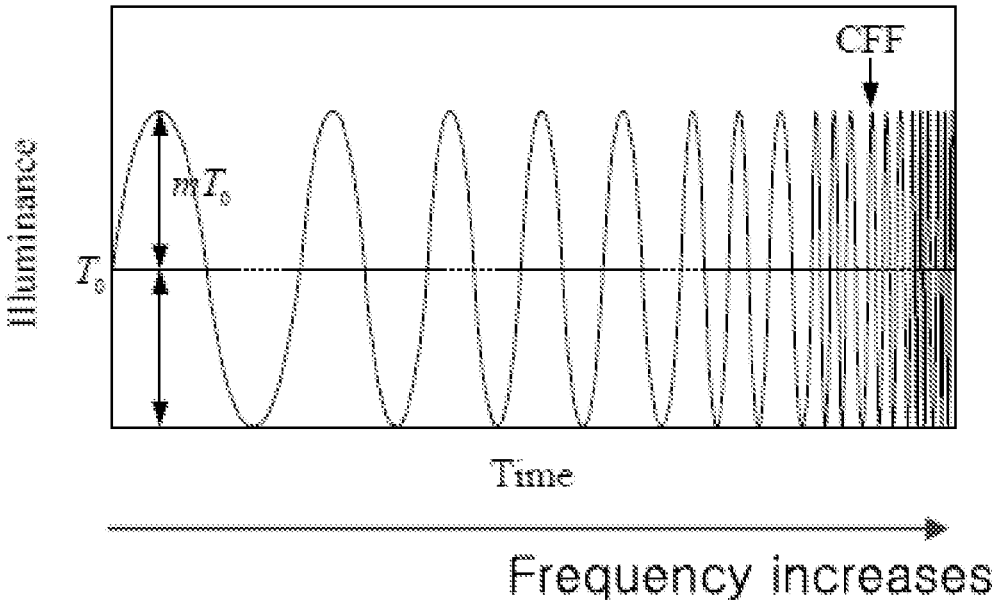
FIG. 2A (RELATED ART)
FIG. 2A is a view showing the waveform of a physically applied luminance stimulus signal.
Figure 2B:
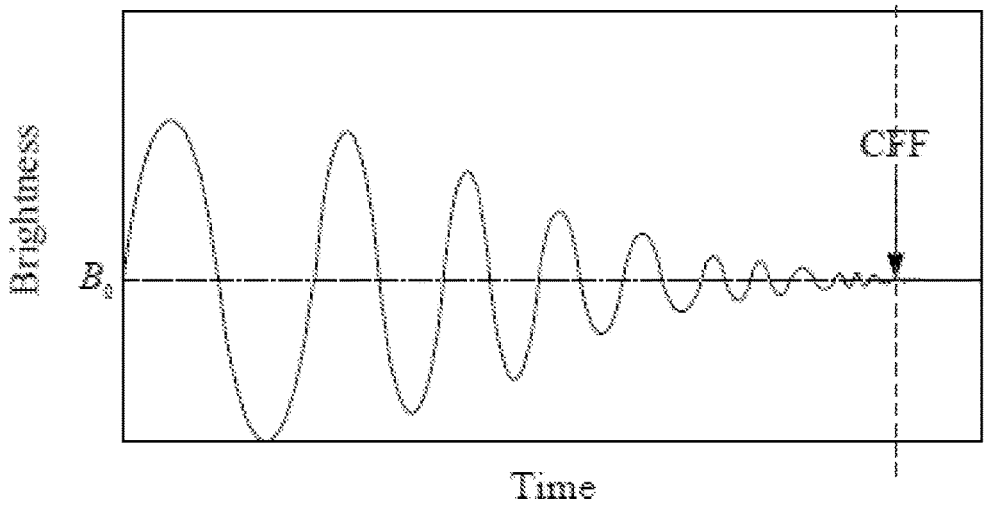
FIG. 2B (RELATED ART)
FIG. 2B is a view showing the waveform of a brightness signal perceived by the human eye.
Figure 3:
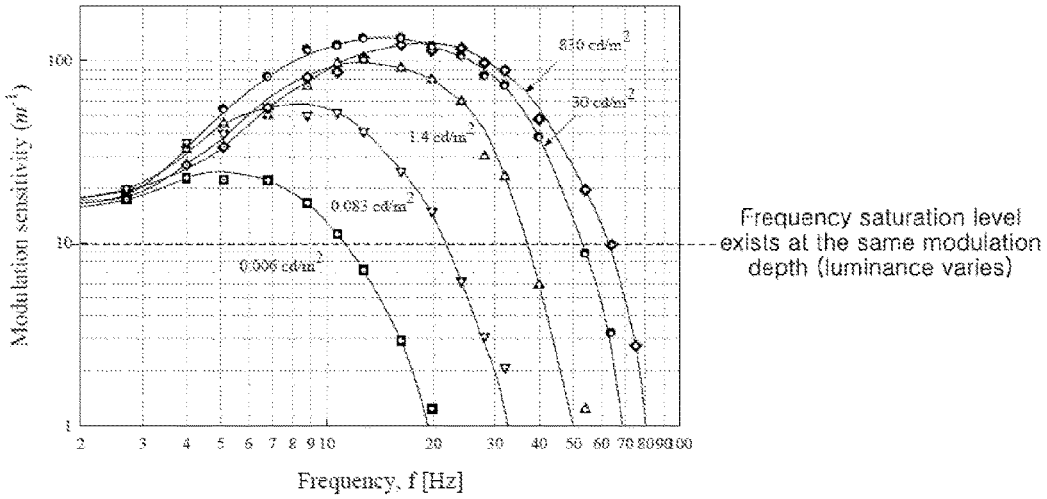
FIG. 3 (RELATED ART)
FIG. 3 is a view illustrating a Kelly's critical modulation depth curve.
Figure 4:
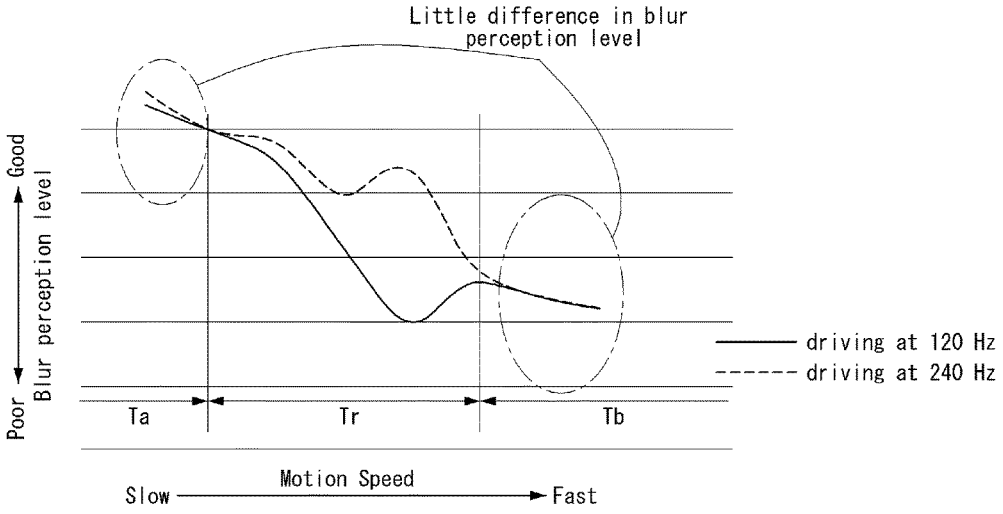
FIG. 4 (RELATED ART)
FIG. 4 is a view illustrating differences in motion blur perception according to variations in frame frequency.

FIG. 2*a* to FIG. 3 are views for explaining the causes of differences in motion blur perception level. FIGS. 2A and 2B are illustrations of flicker and critical fusion frequency (CFF). FIG. 3 is a view illustrating a Kelly's critical modulation depth curve. FIG. 4 is a view illustrating differences in motion blur perception according to variations in frame frequency.

Motion blur is caused by an image integration effect which temporarily lasts as the human eye follows moving objects. A certain length of time is required to form a visual image. However, once a visual image is formed, this effect lasts for a while even after the image disappears. The capability to sense light works within a certain range, and the lower limit of this capability is referred to as light threshold. Light intensity and duration, which are two factors for determining light threshold, are complementary to each other. This is referred to as Block's law. This law is valid under the condition that the duration of light ranges from 10 to 100 ms. They are not complimentary to each other when the light duration goes over this range; especially, when the light duration ranges from 250 to 1000 ms, the capability to sense light is determined by the light intensity alone, regardless of the light duration.

A contrast pattern for measuring temporal frequency characteristics is usually expressed by Equation 1:

$$A(t)=A_0(1+m\cos 2\pi ft) \quad \text{[Equation 1]}$$

wherein A0 is the average luminance, m is the modulation depth, and f is the frequency. Test methods include a first method of obtaining a critical discriminant value by changing the modulation depth m while keeping the time frequency f constant and a second method of obtaining a critical value by changing the time frequency f while the modulation depth m is fixed. The former method involves obtaining the transfer function of a visual system, i.e., a time-frequency characteristic, and the latter method involves obtaining a critical fusion frequency characteristic.

Flicker refers to a phenomenon in which one perceives changes in the luminance of a test screen with time. This phenomenon depends on luminance-varying frequency and average luminance. As the luminance-varying frequency increase, flicker is no longer seen and the luminance level becomes constant. The frequency at which this occurs is called critical fusion frequency or critical flicker frequency (CFF). The flicker and the CFF are illustrated in FIGS. 2A and 2B. FIG. 2A and Equation 2 show the waveform of a physically applied luminance stimulus signal. FIG. 2B and Equation 3 show the waveform of a brightness signal perceived by the human eye.

$$A(t) = T_0(1 + m\cos 2\pi ft) \quad \text{[Equation 3]}$$

$$m = \frac{\Delta T_0}{T_0}, (0 < m < 1)$$

$$B(t) = B_0(1 + m'\cos 2\pi ft) \quad \text{[Equation 3]}$$

The brightness the eye perceives at frequencies equal to or higher than the critical fusion frequency corresponds to the average value of alternating current-varying radiance signals for one period. That is, the human eye perceives a stimulus as being the same at frequencies equal to or higher than the critical fusion frequency.

Regarding this, Kelly conducted a test to obtain CFF with respect to eye adaptation luminance by using a whole white screen with a viewing angle of 65 degrees. The test result is shown in FIG. 3. Each curve represents the results of tests performed at different levels of adaptation luminance of 830, 30, 1.4, 0.083, and 0.0006 cd/m$^2$. Flicker is perceived in the area under the curve of modulation depth versus adaptation luminance shown in FIG. 3.

Based on this fact, it can be found out that when quite a large motion change on an image occurs as shown in FIG. 4, the human eye cannot perceive any difference in motion blur in spite of changes in frame frequency. In other words, referring to FIG. 4, when the image moving speed is within a reference range Tr, the motion blur perception level increases in proportion to the frame frequency, whereas when the image moving speed is out of the reference range Tr (i.e., Ta and Tb), the motion blur perception level is substantially the same regardless of changes in frame frequency. For example, adjusting the frame frequency from 120 Hz to 240 Hz at Tb where the image moving speed is high makes no substantial difference in motion blur perception level between before and after the frequency adjustment.

Figure 5:
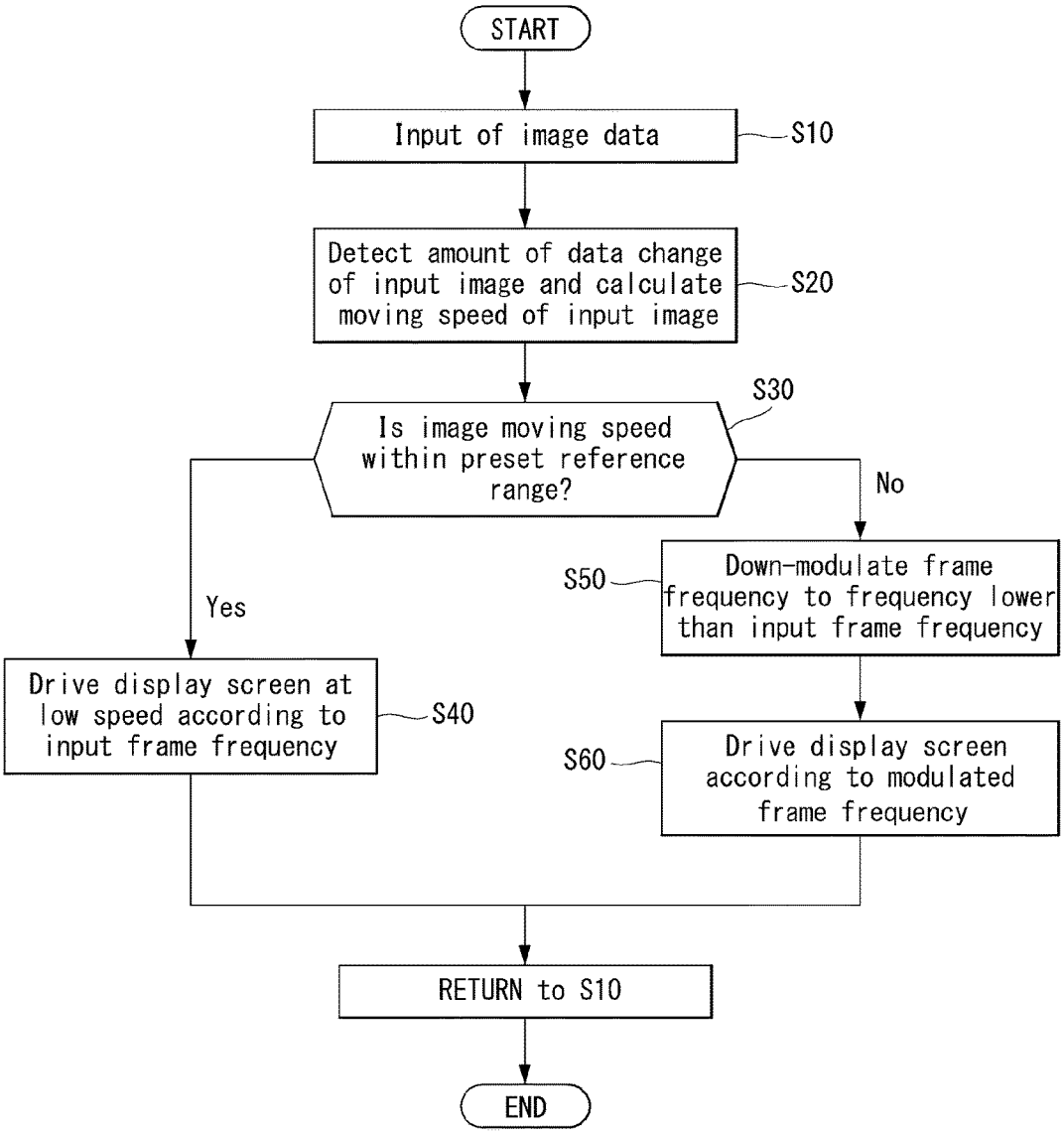
FIG. 5 is a view sequentially showing a method of reducing motion blur on an image display device according to an exemplary embodiment of the present invention.

FIG. 5 sequentially shows a method of reducing motion blur on an image display device according to an exemplary embodiment of the present invention.

In the method of reducing motion blur on the image display device according to the exemplary embodiment of the present invention, when the image moving speed is too high, the frame frequency is down-modulated to drive the display screen at low speed and therefore reduce power consumption, based on the fact that when the image moving speed is too high, there is no difference in motion blur perception before and after a frame frequency variation.

Referring to FIG. 5, the method of reducing motion blur on the image display device according to the present invention will be described below.

In the method of reducing motion blur on the image display device according to the exemplary embodiment of the present invention, when image data is input from the system, the amount of data change of the input image is detected, and the moving speed of the input image is calculated (S10 and S20). In the present invention, the amount of data change in at least part of the data corresponding to neighboring frames of the input image can be detected. For example, data of the current input frame (nth frame) and data of the previous frame (n−1th frame) stored in memory may be compared. That is, a specific range of data corresponding to neighboring frames may be compared, or all ranges of data corresponding to neighboring frames may be compared. The memory may be a line memory or a frame memory.

In the present invention, the moving speed of the input image is calculated according to the detected amount of data change of the input image. The present invention may use, but is not limited to, a well-known motion detector to calculate the image moving speed. Various well-known techniques may be used to calculate the image moving speed.

In the method of reducing motion blur on the image display device, whether the image moving speed is within a preset reference range (S30).

In the method of reducing motion blur on the image display device, when the image moving speed is within the reference range (Tr of FIG. 4), the display screen is driven at high speed according to an input frame frequency, thus improving the motion blur perception level (S40). The input frame frequency may be, but not limited to, 120 Hz or 240 Hz.

In the method of reducing motion blur on the image display device, when the image moving speed is out of the reference range (Tr of FIG. 4), the frame frequency is down-modulated to a frequency lower than the input frame frequency to drive the display screen at low speed according to the modulated frame frequency, thus reducing power consumption (S50 and S60). The modulated frame frequency may be, but not limited to, 60 Hz.

By decreasing the frame frequency in Tb as compared to Tr in FIG. 4, the present invention can greatly reduce power consumption, unlike the related art, while keeping the motion blur perception level as the related art.

FIG. 6 shows a result of a motion blur perception test performed on multiple test images with different motion speeds. FIG. 7 shows a comparison of power consumption between when a specific test image is driven at 120 Hz frame frequency and when it is driven at 240 Hz frame frequency.

The present inventor observed the changes in motion blur on each image, perceived by six males and six females, at frame frequencies 120 Hz (TM120) and 240 Hz (TM240). As mentioned above, the test images IMG2 and IMG3 whose moving speed is within the reference range (Tr of FIG. 4) showed better levels of motion blur perception at 240 Hz than at 120 Hz. On the other hand, the test image IMG1 whose moving speed is within Ta of FIG. 4 and the test image IMG4 whose moving speed is within Tb of FIG. 4 showed little difference in motion blur perception level between 120 Hz and 240 Hz. From the test result of FIG. 5, it can be seen that, when the image moving speed is out of a proper range and becomes faster, the motion blur perception level is not improved even with increased frequency. This suggests that the motion blur perception level is kept substantially the same regardless of variations in frame frequency.

Accordingly, it can be concluded that, when the image moving speed is out of a proper range and becomes faster, it makes no difference in motion blur perception level and this is more advantageous in terms of power consumption, as illustrated in FIG. 7. FIG. 7 illustrates an example where the power consumption at 120 Hz is lower by about 32% than that at 240 Hz.

Figure 8:
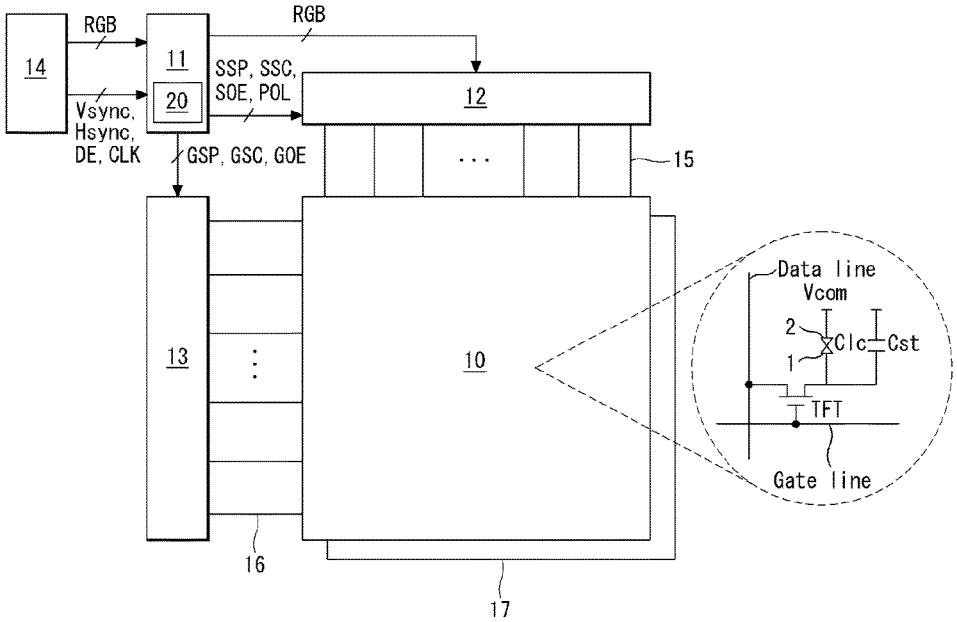
FIG. 8 shows an image display device according to the present invention which is capable of improving motion blur perception level and reducing power consumption.
Figure 9:
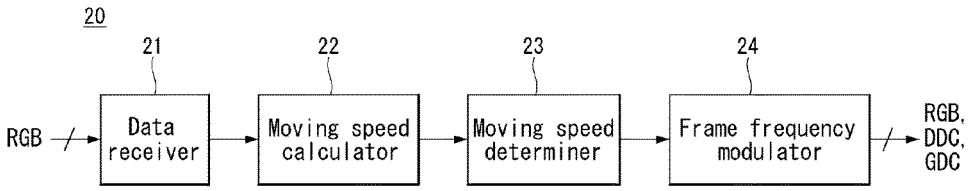
FIG. 9 shows in detail the motion blur controller of FIG. 8.

FIG. 8 shows an image display device according to the present invention which is capable of improving motion blur perception level and reducing power consumption. FIG. 9 shows in detail the motion blur controller 20 of FIG. 8.

Referring to FIG. 8, the image display device of the present invention may be implemented as a hold-type display device, for example, a liquid crystal display (LCD), an organic light emitting diode (OLED), etc. In the following description, the image display device will be described focusing on a liquid crystal display, but it should be noted that the image display device is not limited to the liquid crystal display.

A liquid crystal display panel 10 has a liquid crystal layer formed between two glass substrates. The liquid crystal display panel 10 comprises liquid crystal cells Clc arranged in a matrix format according to a crossing structure of data lines 15 and gate lines 16.

A pixel array is formed on the lower glass substrate of the liquid crystal display panel 10. The pixel array comprises the liquid crystal cells Clc formed at crossings of the data lines 15 and the gate lines 16, TFTs (thin film transistors) connected to pixel electrodes 1, common electrode facing the pixel electrodes 1, and storage capacitors Cst. The liquid crystal cell Clc is connected to the TFT and driven by an electric field between the pixel electrode 1 and the common electrode 2. A black matrix, red (R), green (G), and blue (B) color filters, etc. are formed on the upper glass substrate of the liquid crystal display panel 10. Polarizers are respectively attached to the upper and lower glass substrates of the liquid crystal display panel 10. An alignment layer for setting a pre-tilt angle of liquid crystal is formed on the upper and lower glass substrates of the liquid crystal display panel 10.

The common electrode 2 is formed on the upper glass substrate in a vertical electric field driving manner such as a twisted nematic (TN) mode and a vertical alignment (VA) mode. On the other hand, the common electrode 2 is formed on the lower glass substrate along with the pixel electrodes 1 in a horizontal electric field driving manner such as an in-plane switching (IPS) mode and a fringe field switching (FFS) mode.

The liquid crystal display panel 10 applicable to the invention may be implemented in any liquid crystal mode as well as the TN, VA, IPS, and FFS modes. Moreover, the liquid crystal display according to the present invention may be implemented as any type liquid crystal display including a transmissive liquid crystal display, a semi-transmissive liquid crystal display, and a reflective liquid crystal display. A backlight unit 17 is necessary in the transmissive liquid crystal display and the semi-transmissive liquid crystal display. The backlight unit 17 may be a direct type backlight unit or an edge type backlight unit.

The timing controller 11 receives digital video data RGB of an input image from a host system 14 in a low voltage differential signaling (LVDS) interface manner (or mini-LVDS interface manner) and supplies the digital video data RGB of the input image to a source driver 12 in the mini-LVDS interface manner. The timing controller 11 aligns the digital video data RGB input from the host system 15 in accordance with the arrangement of the pixel array and supplies it to the source driver 12.

The timing controller 11 receives timing signals, such as a vertical synchronization signal Vsync, a horizontal synchronization signal Hsync, a data enable signal DE, a dot clock signal CLK, etc from the host system 14 and generates control signals for controlling the operation timing of the source driver 12 and the gate driver 13. The control signals comprise a gate timing control signal GDC for controlling the operation timing of the gate driver 13 and a source timing control signal SDC for controlling the operation timing of the source driver 12.

The gate timing control signal GDC comprises a gate start pulse GSP, a gate shift clock GSC, a gate output enable signal GOE, etc. The gate start pulse GSP is applied to a gate drive integrated circuit (IC) to control the gate drive IC to generate a first gate pulse. The gate shift clock GSC is a clock signal commonly input to the gate drive ICs, which shifts the gate start pulse GSP. The gate output enable signal GOE controls the output of the gate drive ICs.

The source timing control signal SDC comprises a source start pulse SSP, a source sampling clock SSC, a vertical polarity control signal POL, a horizontal polarity control signal HINV, a source output enable signal SOE, etc. The source start pulse SSP controls the data sampling start timing of the source driver 12. The source sampling clock SSC is a clock signal for controlling the sampling timing of data in the source driver 12 based on a rising or falling edge. The vertical polarity control signal POL controls the vertical polarity of data voltages sequentially output from each of the source drive ICs. The source output enable signal SOE controls the output timing of the source driver 12.

The timing controller 11 comprises a motion blur controller 20, calculates image moving speed, and when the image moving speed is within a reference range, outputs digital video data RGB, a gate timing controller signal GDC, and a source timing control signal SDC according to an input frame frequency and drives the display panel 10 at high speed, thereby improving the motion blur perception level. On the other hand, when the image moving speed is out of the reference range (particularly, when the image moving speed exceeds the reference range), the timing controller 11 down-modulates the frame frequency to a frequency lower than the input frame frequency and outputs digital video data RGB, gate timing controller signal GDC, and source timing control signal SDC according to the modulated frame frequency and drives the display panel 10 at low speed, thereby reducing power consumption.

To this end, as shown in FIG. 9, the motion blur controller 20 may comprise a data receiver 21, a moving speed calculator 22, and a moving speed determiner 24.

The data receiver 21 receives digital video data RGB of an input image from the system 14.

The moving speed calculator 22 detects the amount of data change of the input image, and calculates the moving speed of the input image. The moving speed calculator 22 detects the amount of data change for at least part of the data corresponding to neighboring frames of the input image, and then calculates the moving speed of the input image by various well-known methods.

The moving speed determiner 23 determines whether the moving image speed is within a preset reference range.

The frame frequency modulator 24 drives the display panel 10 at high speed according to the input frame frequency when the image moving speed is within the reference range, and down-modulates the frame frequency to a frequency lower than the input frame frequency and drives the display panel 10 at low speed according to the modulated frame frequency when the image moving speed is out of the reference range. In order to down-modulate the frame frequency to a frequency lower than the input frame frequency, the frame frequency modulator 24 may delete some of the frames of the input image according to the modulated frame frequency, or the frames of the input image may be rendered according to the modulated frame frequency.

As described above, in the present invention, when the image moving speed is within a reference range, the display screen is driven at high speed according to an input frame frequency, thus improving the motion blur perception level, and when the image moving speed exceeds the reference range, the frame frequency is down-modulated to a frequency lower than the input frame frequency to drive the display screen at low speed according to the modulated frame frequency, thus reducing power consumption. Hence, the present invention can improve motion blur perception level and efficiently reduce power consumption.

It will be apparent to those skilled in the art that various modifications and variations can be made in the image display device and driving method thereof of the present invention without departing from the spirit or scope of the invention. Thus, it is intended that the present invention cover the modifications and variations of this invention provided they come within the scope of the appended claims and their equivalents.

What is claimed is:

1. A driving method of an image display device, the driving method comprising:

detecting an amount of data change of an input image and calculating a moving speed of the input image;

determining whether the image moving speed is within a preset reference range, the preset reference range having a lower limit and an upper limit higher than the lower limit;

whenever the image moving speed is determined to be within the reference range, driving a display screen according to an input frame frequency synchronized to the input image;

whenever the image moving speed is determined to exceed the upper limit, down-modulating a frame frequency for displaying the input image to a first modulated frame frequency lower than the input frame frequency and driving the display screen according to the first modulated frame frequency; and whenever the image moving speed is determined to be less than the lower limit, down-modulating a frame frequency to a second modulated frame frequency lower than the input frame frequency and driving the display screen according to the second modulated frame frequency, wherein the frame frequency for displaying the input image is down-modulated only to the first modulated frame frequency or the second modulation frame frequency in all image moving speed ranges excluding the preset reference range, wherein the first modulated frame frequency and the second modulated frame frequency are equal to each other, and wherein the down-modulating of the frame frequency to the first modulated frame frequency includes deleting some of the frames of the input image according to the first modulated frame frequency.

2. The driving method of claim 1, wherein, in the detecting of the amount of data change of the input image, the amount of data change in at least part of the data corresponding to neighboring frames of the input image is detected.

3. The driving method of claim 1, wherein the down-modulating of the frame frequency to the first modulated frame frequency includes rendering the frames of the input image according to the first modulated frame frequency.

4. The driving method of claim 1, wherein the lower limit is greater than 0.

5. The driving method of claim 1, wherein the down-modulating of the frame frequency to the second modulated frame frequency includes deleting some of the frames of the input image according to the second modulated frame frequency.

6. The driving method of claim 1, wherein the down-modulating of the frame frequency to the second modulated frame frequency includes rendering the frames of the input image according to the second modulated frame frequency.

7. An image display device, comprising:

a display screen for displaying an input image;

a moving speed calculator configured to detect an amount of data change of an input image and calculates a moving speed of the input image;

a moving speed determiner configured to determine whether the image moving speed is within a preset reference range, the preset reference range having a lower limit and an upper limit higher than the lower limit; and a frame frequency modulator configured to:

whenever the image moving speed is determined to be within the preset reference range, drive the display screen according to an input frame frequency synchronized to the input image;

whenever the image moving speed is determined to exceed the upper limit, down-modulate a frame frequency for displaying the input image to a first modulated frame frequency lower than the input frame frequency and drive the display screen according to the first modulated frame frequency; and whenever the image moving speed is determined to be less than the lower limit, down-modulate a frame frequency for displaying the input image to a second modulated frame frequency lower than the input frame frequency and drive the display screen according to the second modulated frame frequency, wherein the frame frequency for displaying the input image is down-modulated only to the first modulated frame frequency or the second modulation frame frequency in all image moving speed ranges excluding the preset reference range, wherein the first modulated frame frequency and the second modulated frame frequency are equal to each other, and wherein the frame frequency modulator is further configured to delete some of the frames of the input image according to the first modulated frame frequency whenever the image moving speed is determined to exceed the upper limit.

8. The image display device of claim 7, wherein the moving speed calculator is further configured to detect the amount of data change in at least part of the data corresponding to neighboring frames of the input image.

9. The image display device of claim 7, wherein the frame frequency modulator is further configured to delete some of the frames of the input image according to the second modulated frame frequency whenever the image moving speed is determined to be less than the lower limit.

10. The image display device of claim 7, wherein the frame frequency modulator is further configured to render the frames of the input image according to the first modulated frame frequency or the second modulated frame frequency whenever the image moving speed is determined to exceed the upper limit or be less than the lower limit, respectively.

11. The image display device of claim 7, wherein the lower limit is greater than 0.

* * * * *